US005189973A

United States Patent [19]

Krumme et al.

[11] Patent Number: 5,189,973

[45] Date of Patent: Mar. 2, 1993

[54] LOOPER WHICH ROTATES IN A HORIZONTAL PLANE FOR A DOUBLE LOCK-STITCH SEWING MACHINE

[75] Inventors: Thomas Krumme; Robert Strohl; Dieter Wachter, all of Bielefeld, Fed. Rep. of Germany

[73] Assignee: Dürkopp Adler Aktiengesellschaft, Fed. Rep. of Germany

[21] Appl. No.: 674,532

[22] Filed: Mar. 22, 1991

[30] Foreign Application Priority Data

Mar. 22, 1990 [DE] Fed. Rep. of Germany ..... 4009203

[51] Int. Cl.[5] ..... D05B 57/14; D05B 65/02

[52] U.S. Cl. ..... 112/231; 112/292

[58] Field of Search ..... 112/181, 184, 292, 298, 112/289, 228, 231, 302, 229

[56] References Cited

U.S. PATENT DOCUMENTS

| | | | |
|---|---|---|---|
| 1,146,406 | 7/1915 | Diehl et al. | 112/228 |
| 2,583,538 | 1/1952 | Backlin | 112/231 |
| 3,486,473 | 12/1969 | Ross | 112/229 |
| 3,658,021 | 4/1972 | Hedegaard et al. | 112/292 |
| 3,709,174 | 1/1973 | Garry | 112/231 |
| 4,275,675 | 6/1981 | Killinger | 112/231 X |
| 5,025,737 | 6/1991 | Kamiya | 112/184 X |

FOREIGN PATENT DOCUMENTS 1941681 6/1971 Fed. Rep. of Germany .

*Primary Examiner*—Peter Nerbun
*Assistant Examiner*—Paul C. Lewis
*Attorney, Agent, or Firm*—Ostrolenk, Faber, Gerb & Soffen

[57] ABSTRACT

The bobbin case which is received by the looper has an upstanding generally cylindrical wall which surrounds the looper-thread bobbin. Forming part of the wall is a free-standing finger against which an end of a leaf spring rests. The looper thread, which has been withdrawn from the looper-thread bobbin and wrapped around the finger, is pulled through the constricted place between the leaf spring and the finger and then conducted through a threading slot provided by a radially-extending cam on the outer surface of the wall. The looper thread then comes against an inclined, downward-facing shoulder provided on the outside of the wall, slides down the shoulder, and passes finally into a long horizontal slot in the wall. The looper thread exits the bobbin case at an end point of the horizontal slot for being dependably caught by a thread catcher of a thread-cutting device.

25 Claims, 7 Drawing Sheets

LOOPER WHICH ROTATES IN A HORIZONTAL PLANE FOR A DOUBLE LOCK-STITCH SEWING MACHINE

BACKGROUND OF THE INVENTION

The present invention relates to a looper which rotates in a horizontal plane, preferably for a double lock-stitch sewing machine.

More particularly, the invention relates to a bobbin case for such a looper, having improved elements for guiding the thread contained therein.

Such a looper typically has a bobbin case, which is secured against rotation, with a looper-thread bobbin within it An adjustable leaf spring is provided on its circumference, and the bobbin case wall. has an opening for the emergence of a looper thread. Such a looper may be equipped with a thread-cutting device. The thread-cutting device may include a thread catcher which is swingable in a horizontal plane which lies below the plane of the top of the bobbin case.

A looper which has the foregoing features is known from German Patent No. 19 41 681 and U.S Pat. No. 3,658,021. The known looper has a bobbin case which is secured against rotation and consists of two parts, comprising an upper bobbin-case part and a lower bobbin-case part The lower bobbin-case part, which is mounted in the lopper, receives the upper part in form-locked manner by suitable shaping, the looper-thread bobbin being placed between said parts. By means of a swingable retaining clip which is mounted in a spindle sleeve provided in the lower part of the bobbin case, the assembled upper and lower bobbin-case parts can be locked in position. A protruding circumferential surface on the upper part of the bobbin case receives on its periphery an adjustable leaf spring for applying a defined thread tensioning force to the looper thread. Furthermore, an opening for the emergence of the looper thread is provided in the wall surface, under the spring arm of the leaf spring.

A known thread cutting device for such a double lock-stitch sewing machine has, inter alia, a thread catcher which is swingable in a horizontal plane, which lies below the plane of the top of the bobbin case. In this way, it is made possible to cut both the part of the needle-thread loop which leads to the material being sewn, and the looper thread, closely below the material being sewn.

However, a significant disadvantage of the known looper is that the bobbin case consists of two parts. Due to this two-part construction, the time required for changing bobbins (replacement of an empty looper-thread bobbin by a full one), as well as for threading the looper-thread, is frequently considered unreasonably long Furthermore, a bobbin case which consists of two parts results in greater manufacturing and stocking expenses than a bobbin case consisting of a single part.

SUMMARY OF THE INVENTION

The object of the present invention is, therefore, to develop a looper of this type with a one-piece bobbin case, developed at minimum manufacturing expense, which makes it possible, in cooperation with a thread catcher of the thread-cutting device, to cut the part of the needle-thread loop leading to the material being sewn, as well as to cut the looper thread, just below the material being sewn.

This object may be achieved by a looper wherein the bobbin case is developed as a single part, and has advantageous elements for guiding the looper thread These elements may include a freely extending finger arranged to form part of the wall of the bobbin case. The bobbin case also may have a shoulder which begins close to the finger and extends over a lower part of the circumference of the wall surface, with a radially outer face that descends obliquely toward a bottom side of the bobbin case. The bobbin case may also include a horizontal cam which extends horizontally from an upper part of the wall, above the finger and at least part of the shoulder.

According to a particularly advantageous aspect of the invention, the cam and the shoulder guide the thread from the bobbin into a position for being caught by the thread catcher of the cutting device, and cut at the same time as the needle thread, just below the sewing workpiece. For this purpose, the thread may be guided into a generally horizontal slot extending circumferentially in the wall in the looper rotation direction, which permits the looper thread to be pulled in the rotation direction by a needle-thread loop carried by the looper, to a downstream end of that slot, and thereby into the desired position.

According to another advantageous feature, the bobbin case may have an upstanding generally cylindrical wall with at least first, second and third apertures therein, numbered according to the direction of rotation of said looper, the apertures being open at the top surface of the bobbin case and providing a thread path from the interior to the exterior of said bobbin case, wherein a thread from the bobbin may exit through the first aperture, re-enter through the second aperture, and then exit through the third aperture. The first and second apertures may be defined by the upstanding finger which forms part of the wall. Guide means may be provided for guiding a thread into the second and third apertures to complete the threading of the bobbin case. The guide means may comprise a cam which extends radially outward from the top of the wall, the cam being penetrated by an outlet formed therein, the outlet having an obliquely directed threading slot which interrupts the cam for receiving a thread. After being received by the threading slot, the thread may be guided by the above-mentioned shoulder, downward into the horizontal slot.

With the looper of the invention, the result is advantageously obtained that its bobbin case, which is made as a single part, is so developed that it permits the looper thread withdrawn from the looper-thread bobbin to be placed easily under the leaf spring in order to produce a well-defined thread-tensioning force, and, furthermore, that the end of the looper thread is automatically brought to an opening provided for it in the wall surface of the bobbin case. The last-mentioned result, directed at automatically bringing the thread into place, is obtained without any action on the part of the operator, in that the needle-thread loop, towards the end of its wrapping of the bobbin case, carries along the end of the looper thread which hangs out of the case and brings it to a designated point in the aforementioned opening in the wall of the bobbin case. In this way, it is assured that the thread catcher, which moves rearwardly and horizontally in a plane below the top of the bobbin case, will catch and grip not only the looper thread which has emerged from the bobbin case, but also the part of the needle-thread loop leading to the material being sewn Thus the invention assures that the two threads will be cut just below the material being sewn.

A further advantage of the one-part bobbin case is that the operator can easily load and unload bobbins. The operator also can easily note the amount of thread which is present on the looper-thread bobbin, in that a number of holes are provided in the flanges of the looper-thread bobbin and, furthermore, the cover slide which is mounted in the base plate of the sewing machine permits a view of the top of the bobbin case.

Other objects, features and advantages of the present invention will become apparent from the following description of an embodiment of the invention, which refers to the accompanying drawings.

BRIEF DESCRIPTION OF THE DRAWINGS

One embodiment of the invention will be explained with reference to FIG. 1 to 7, in which.

DETAILED DESCRIPTION OF THE DRAWINGS

Figure 1:
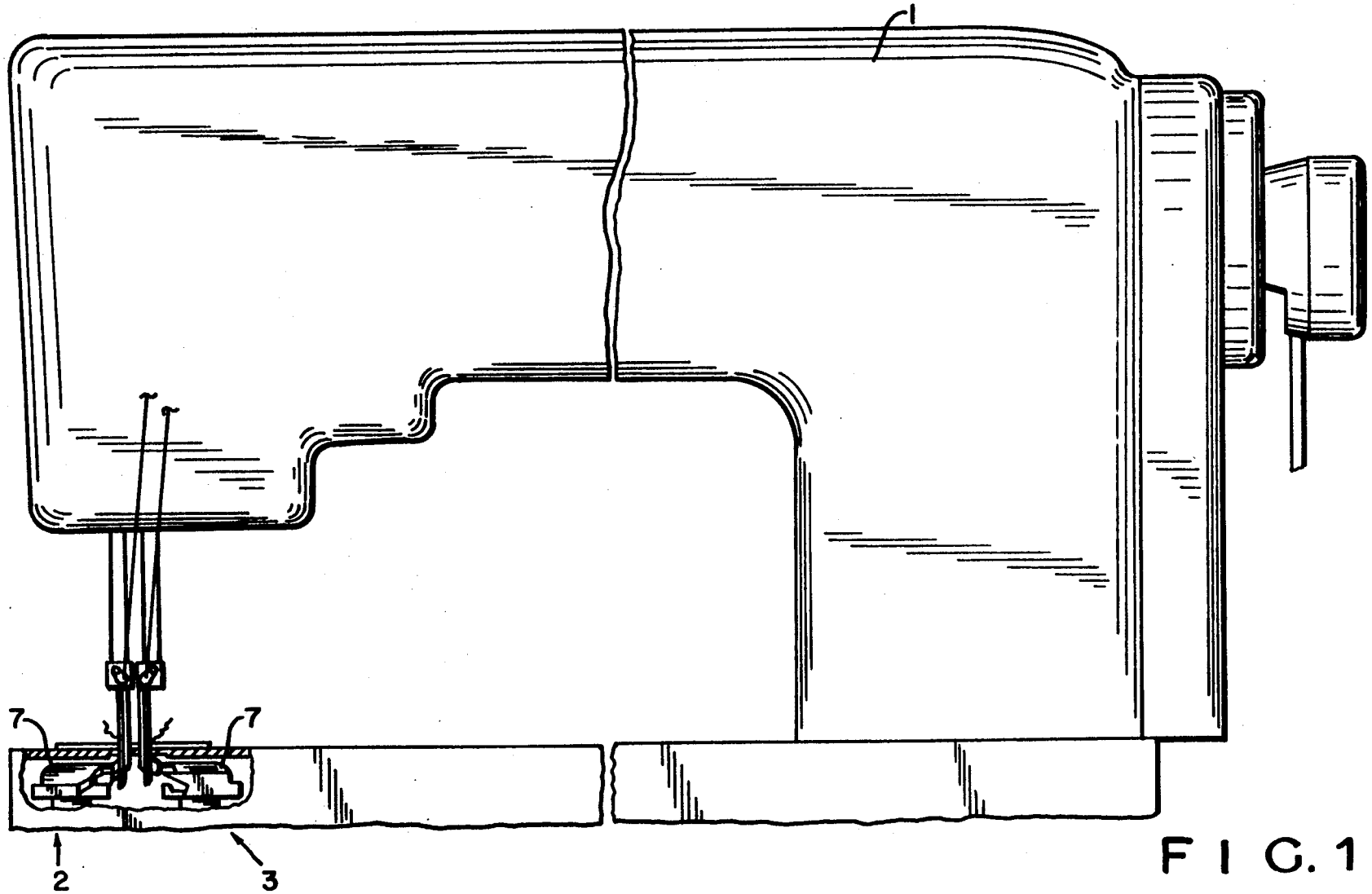
FIG. 1 is a simplified elevation of a two-needle sewing machine having two loopers rotating in a horizontal plane.

A two-needle double lock-stitch sewing machine 1 is shown in FIG. 1 and is equipped with two vertical-shaft loopers 2, 3. The looper tips thereof move in a horizontal plane It should be noted that the invention is also usable with a single-needle double lock-stitch sewing machine and other types of sewing machines (not shown here).

Figure 2:
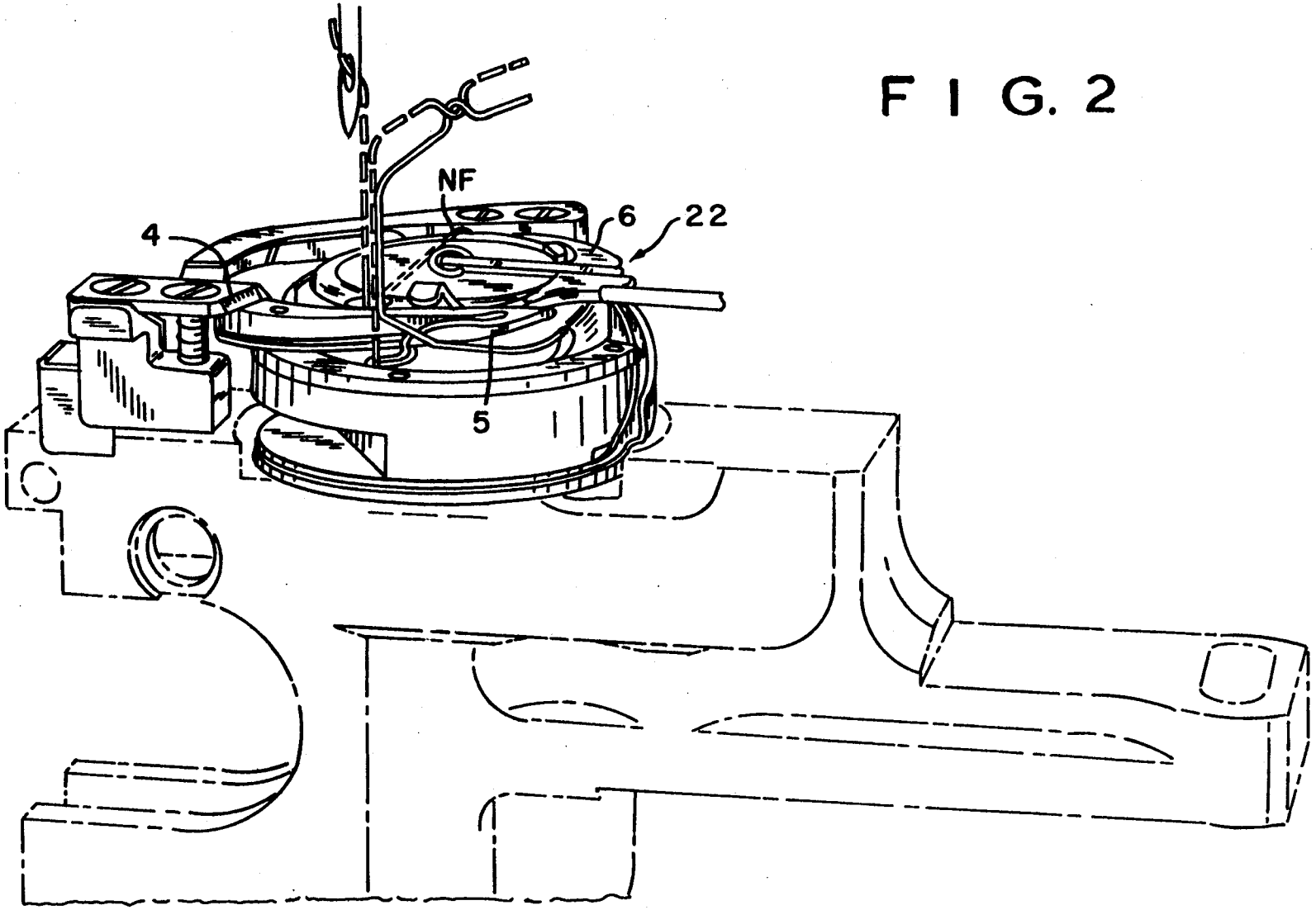
FIG. 2 is a perspective view of a looper and a thread-cutting device, the thread catcher not having not yet reached its final swung-out position.

The double lock-stitch sewing machine 1 is furthermore provided with a thread-cutting device, which can be seen in FIGS. 2 and 3 It includes a stationary cutting knife 4 and a thread catcher 5 which is swingable in a horizontal plane From FIG. 2, it can be noted that the thread catcher 5 moves in a plane which lies below an upper surface 6 of a one-piece bobbin case 7.

The bobbin case is contained in the looper 2 or 3 and receives a looper-thread bobbin 8 which is pushed onto a spindle sleeve 9. The spindle sleeve 9 is firmly attached to the bottom of the bobbin case 4, and, as shown in FIG. 4, is arranged in the center of the bobbin case 7. Within the spindle sleeve 9 is swingably mounted a retaining clip 10 which, in its downwardly swung position, locks the looper-thread bobbin 8 in the bobbin case 7, as shown in FIG. 3. A compression-type spring (not shown) may be provided in the bobbin case 7 to push the bobbin 8 out slightly when it is not locked down by the retaining clip 10, thereby to facilitate removal of the bobbin.

The bobbin case 7 has an erect collar-shaped generally cylindrical outer wall 11, on the outer circumference of which a leaf spring 12 is provided, the spring action of its spring arm being adjustable in known manner.

Figure 4:
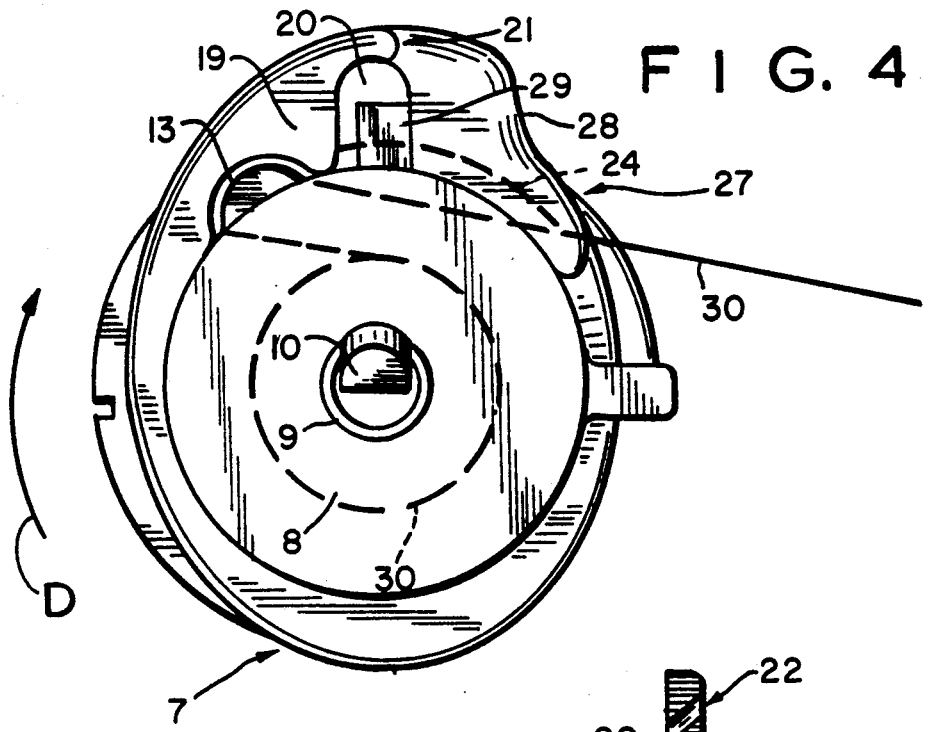
FIG. 4 is a top view of the bobbin case with the looper-thread bobbin inserted, but not yet locked in position by the retaining clip.
Figure 4A:
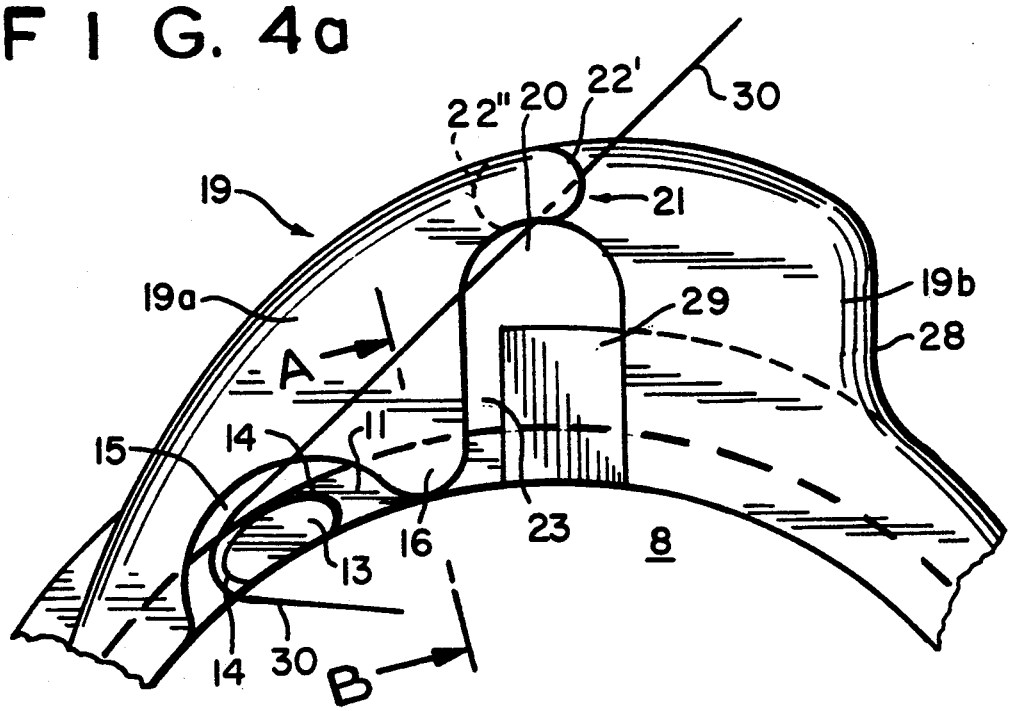
FIG. 4*a* shows, on a larger scale, a detail of the cam shown in FIG. 4.

At a given location in the wall 11, part of the wall 11 is formed by an upstanding finger 13 which is aligned parallel to the spindle sleeve 9, and the surfaces 14 of the finger 13 are rounded on all sides, as shown in FIG. 4*a*. A cam 19 is formed on the wall 11, extending horizontally outward from its top edge and defining the upper surface 6 of the bobbin case, as shown in FIG. 2. The cam 19 comprises an upstream part 19*a* and a downstream part 19*b*, referred to the rotation direction D of the looper (FIG. 4). Owing to a recess 15 formed in the cam part 19*a* surrounding the finger 13, the finger 13 forms a free-standing portion of the wall 11 at that given location The surface of the recess 15 are also rounded.

Figure 4B:
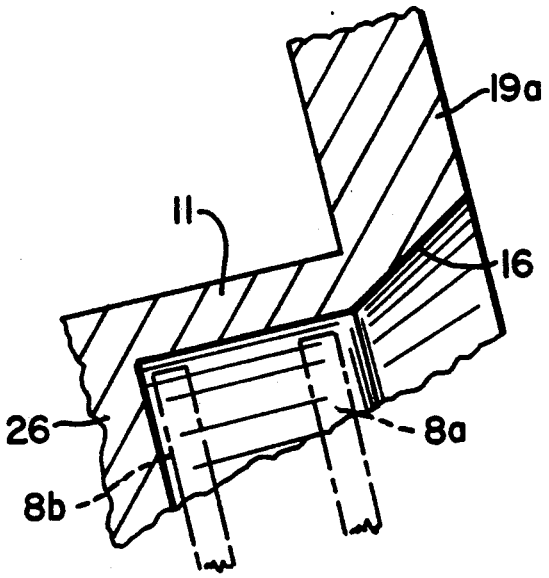
FIG. 4*b* is a sectional view along the section line A-B of FIG. 4*a;*
Figure 4C:
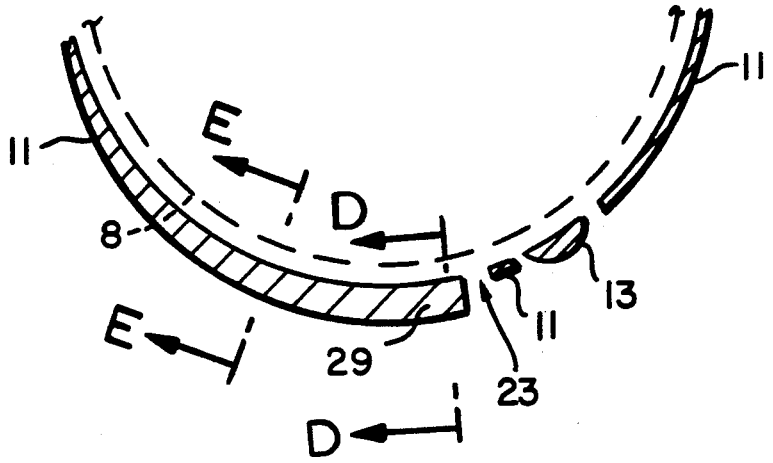
FIG. 4*c* is a cross-section of the wall 11 taken along a horizontal plane C—C as indicated in FIG.
Figure 4D:
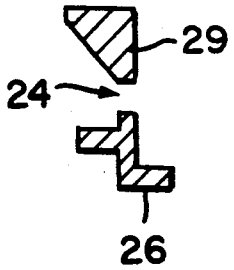
FIGS. 4*d* and 4*e* are further cross-sections off wall 11 taken along the lines D—D and E—E, respectively, in FIG. 4*c;*
Figure 4E:
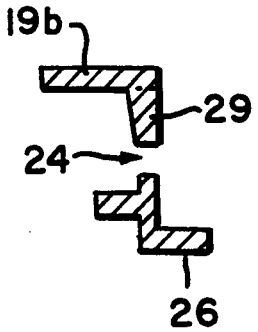

Between the finger 13 and a second recess 20, which is described further below, an oblique slide surface 16 having surfaces rounded on all sides is provided, as shown in FIGS. 4*a* and 4*b*. As best seen in FIGS. 4*a* and 4*b*, the oblique slide surface 16 slopes downward from the flat top surface of the cam part 19*a*, toward the top flange 8*a* of the bobbin 8.

Figure 7:
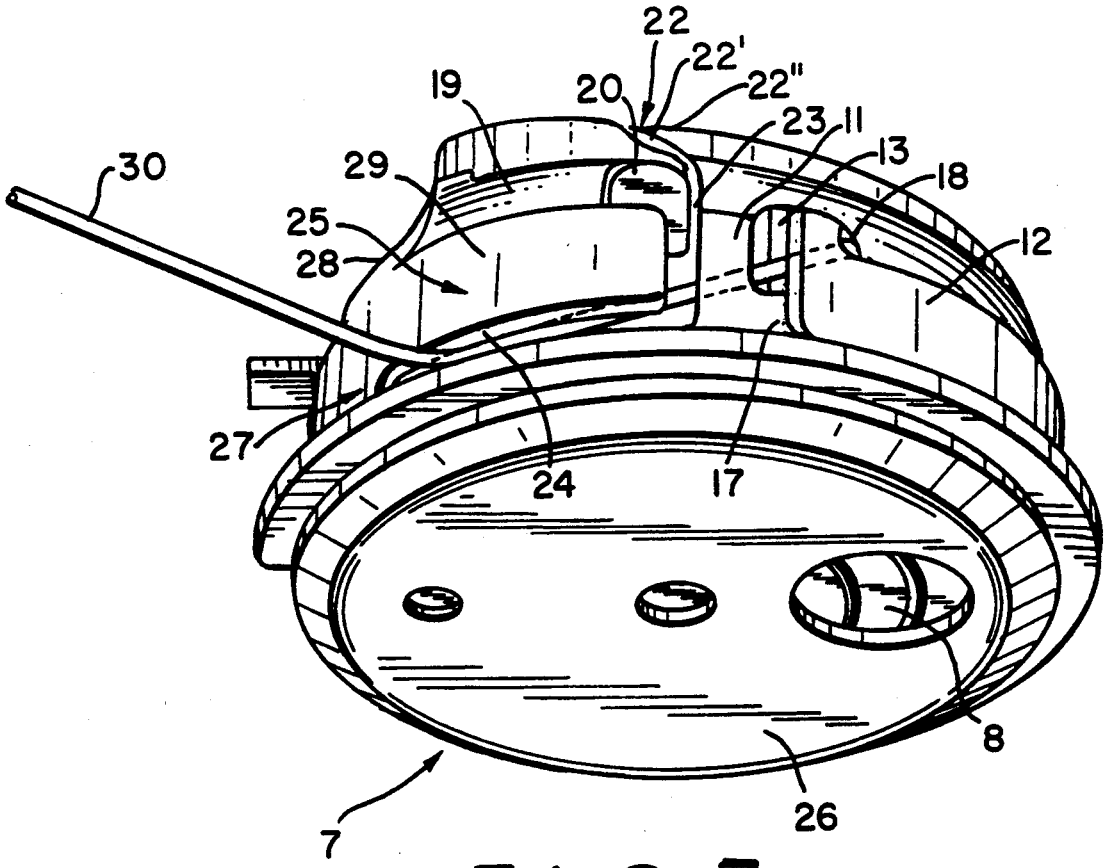
FIG. 7 is a perspective view seen from the rear side of the bobbin case.

The finger 13 is formed within the wall 11 at such a location that a free end 17 of the leaf spring 12 bears against the finger 13. From FIG. 7, it can be noted that a top corner 18 on the free end 17 of the leaf spring 12 is bent radially outward slightly, away from the finger 13.

Figure 3:
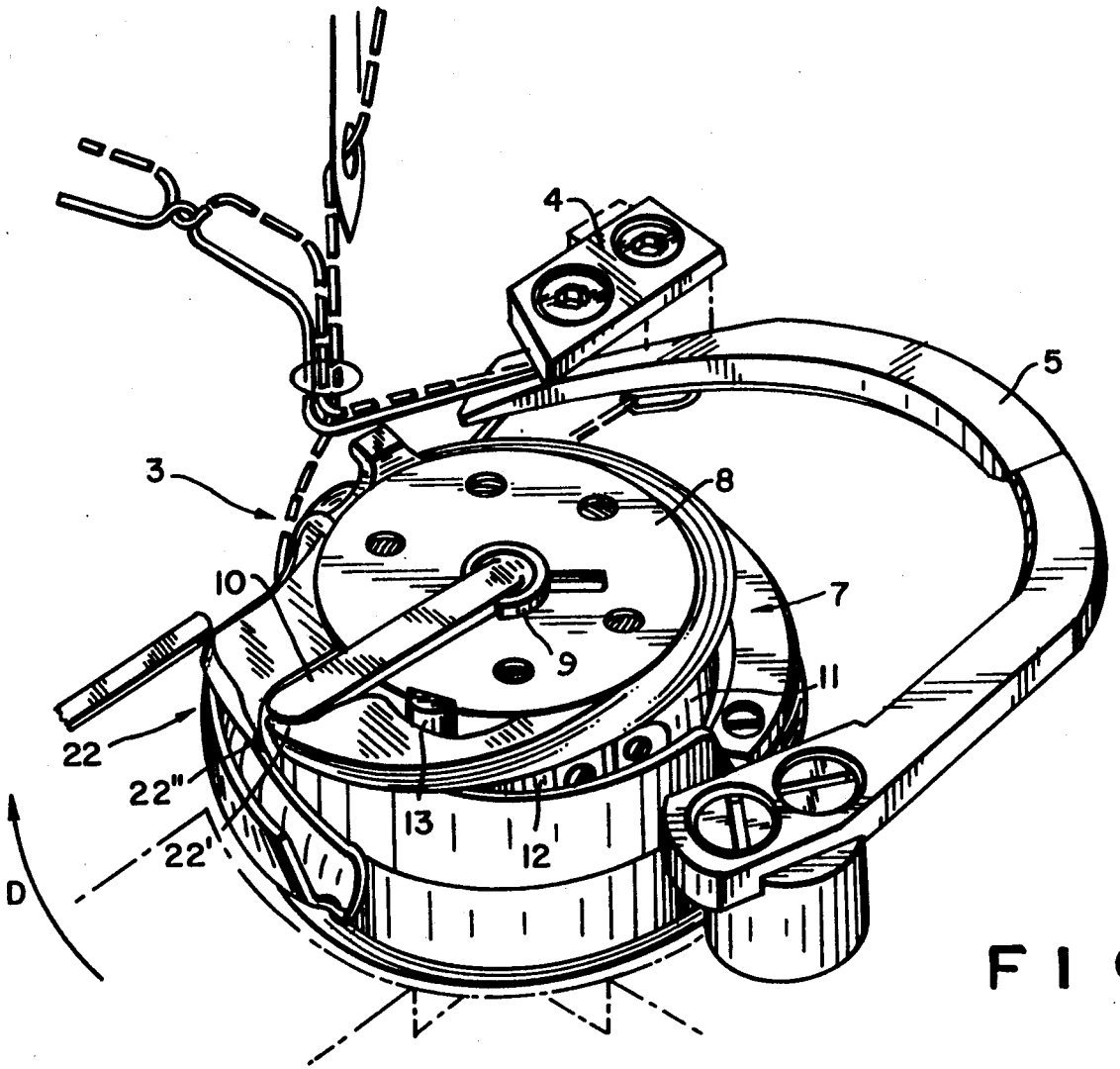
FIG. 3 is a perspective view of the looper, the thread-cutting device, and the thread catcher shortly before the cutting of the thread.

The cam 19 on the bobbin case 4 is generally flat and extends horizontally outward from the top edge of the wall 11 Within the cam 19, between the parts 19*a* and 19*b*, is formed a second recess 20 which, as shown in FIG. 3, receives the retaining clip 10. The recess 20 has an outlet 21, at the radially outermost point of which is a threading slot 22 which is oriented obliquely to the horizontal plane of the looper and bobbin case, and interrupts the cam 19 to define the parts 19*a* and 19*b*, as best shown in FIGS. 3, 4*a*, 6 and 7. The oblique position of the threading slot 22 in the cam 19 is defined by an upper tip 22' on the cam part 19*a* which lies downstream of a lower tip 22" on the cam part 19*b*, referred to the direction of rotation D of the looper 2 or 3. Advantageously, the lower tip 22" may be substantially radially outward of the short slot 23. By the above-mentioned arrangement of the tips 22' and 22" (see FIGS. 3, 4*a*, 6 and 7) the needle thread loop NF which, during the formation of the stitch, wraps around the bobbin case 7 (see FIG. 2) is prevented from being inadvertently pulled into the threading slot 22.

Just beneath the recess 20, a short vertical slot 23 in the wall 11 is defined by the edge of the wall beneath the downstream edge of the cam part 19*a*; and by the upstream edge of a shoulder 29 which is formed on the outside of the wall 11, as seen in FIGS. 4, 4*a*, 6 and 7. The short slot 23 defines an L-shaped channel 25 together with a long slot 24 which is formed in the wall 11 approximately midway between the top and bottom bobbin flanges 8a, 8b when the bobbin 8 is locked in the bobbin case 7. Thus the channel 25 forms an outlet through the wall surface 11 for the looper thread 30. In a preferred embodiment, the channel 25 is L-shaped, the slot 24 extending preferably parallel to the bottom side 26 of the bobbin case 7. The long slot 24 has an end point 27 at one end thereof, namely the downstream end with respect to the direction of rotation D (see FIGS. 4, 6). The end point 27 has a well-defined position with respect to a downstream edge 28 of the cam 19, which permits suitable emergence of a looper thread 30 withdrawn from the looper-thread bobbin 8, as will be discussed further below.

Starting from the short slot 23, the shoulder 29 is provided on the circumference of the wall 11, beneath the cam 19, as shown in FIGS. 4, 4a, 4c–e, 5 and 7. The shoulder 29 has a generally wedge-shaped cross-section and is formed on the outside of the wall 11. It is thickest at the top of the wall 11 and becomes thinner toward the bottom side 26 of the bobbin case 7. Thus it forms an obliquely sloping outer surface for the bobbin case 7. The slope of the shoulder 29 is greatest directly at the short slot 23, said slope continuously decreasing as the shoulder 29 further extends in the direction of rotation D, until the shoulder 29 essentially blends into the outside of the wall 11, beyond the end point 27.

The manner of operation of the looper 2 or 3 of the invention, rotating in a horizontal plane, in cooperation with the thread catcher 5 of the thread-cutting device, will now be described.

Figure 5:
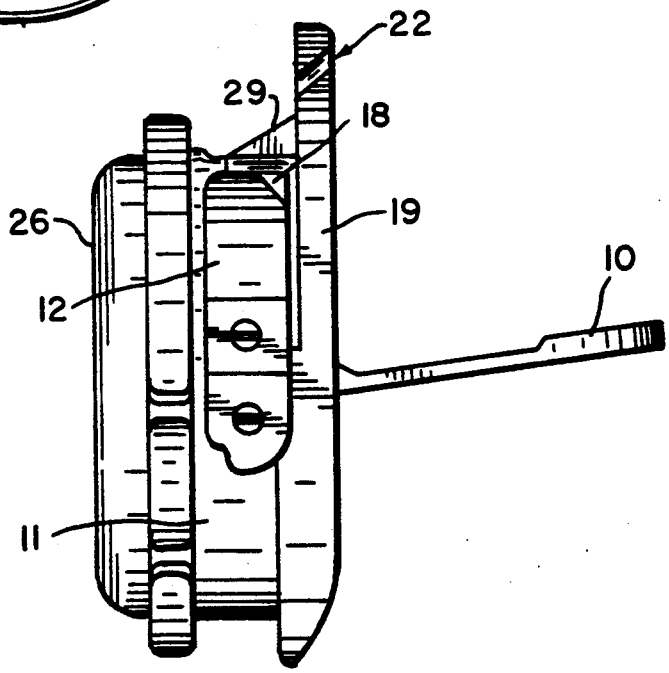
FIG. 5 is a side view of the bobbin case.
Figure 6:
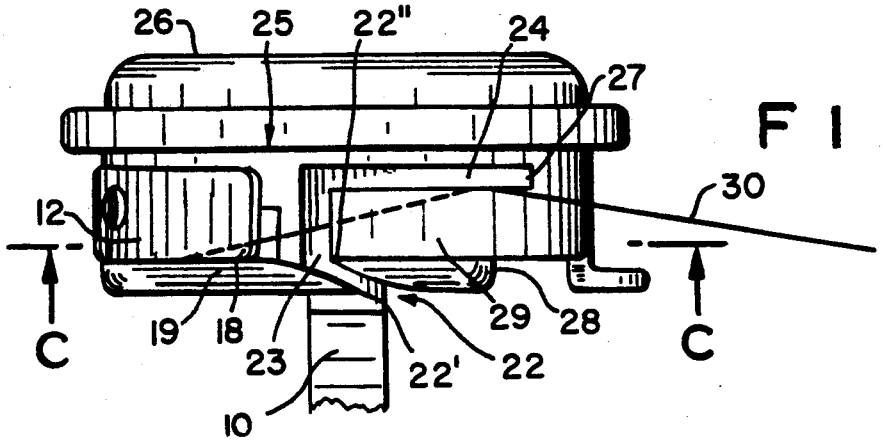
FIG. 6 is a front view of the bobbin case.

When the looper-thread bobbin 8 in the looper 2 or 3 is empty, i e. the supply of thread wound on it has been used up, the retaining clip 10 is swung into the position shown in FIGS. 5 and 6 The empty looper-thread bobbin 8 is then removed from the spindle sleeve 9 and a full looper-thread bobbin 8 is placed on the spindle sleeve 9. Note the direction of unwinding of the wound looper thread 30 which is shown in FIG. 4.

Next, a piece of thread 30 about 50 mm in length is withdrawn from the looper-thread bobbin 8 and is conducted, as shown in FIG. 4a, first around the finger 13 and then to the radially outward end of the threading slot 22, slightly below the tip 22' of the cam part 19a (see FIG. 4a). Then the piece of looper thread 30 is pulled completely through the threading slot 22, and as this is done, the length of thread, which is now slightly tensioned, slides downward and inward along the oblique slide surface 16 into the interior of the wall 11, whereby the entire length of thread is now fully contained within the bobbin case 7. That is, after threading, the thread leaves the bobbin 8, exits the bobbin case as it wraps clockwise around the finger 13, past the leaf spring 12, and then re-enters the bobbin case between the finger 13 and the oblique slide surface 16 Finally, it exits the bobbin case again through the channel 25.

During these steps, as the piece of thread is slid through the threading slot 22, it comes against the radially outward inclined surface of the shoulder 29 and slides down along the latter until the length of thread, which is still in the short slot 23, enters the constricted place (see FIG. 7) which is formed by the free end 17 of the leaf spring 12 and the finger 13 Its entry between the free spring end 17 and the finger 13 is facilitated by the radially outwardly bent corner 18 of the free spring end 17.

At the end of its downward sliding movement along the inclined outer surface of the shoulder 29, the piece of looper thread 30, upon which a defined thread tensioning force is now imposed by the leaf spring 12, reaches the long slot 24.

Figure 8:
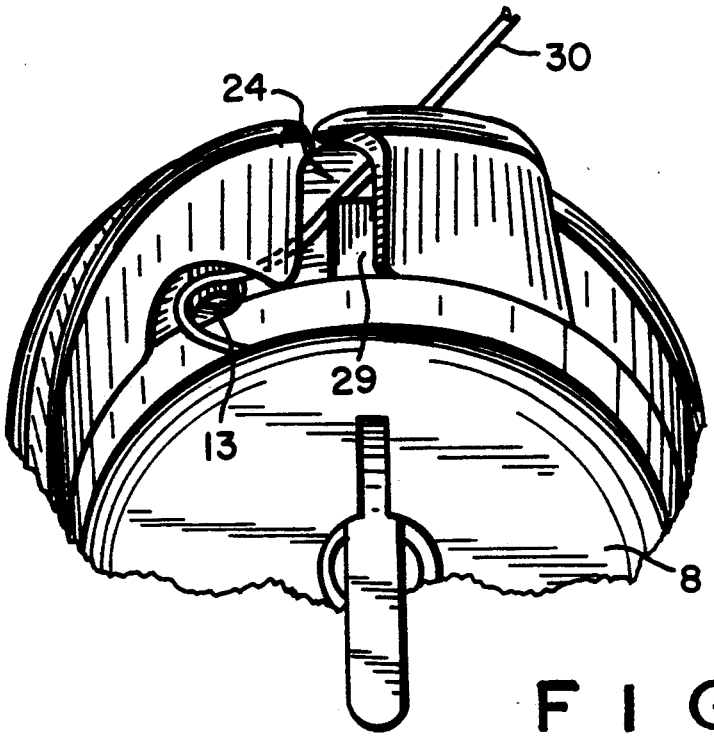
FIG. 8 is a simplified perspective view similar to FIGS. 4 and 4*a*, showing a thread at an intermediate point in the loading process.

FIG. 8 is a simplified perspective view corresponding to FIGS. 4 and 4a, illustrating an intermediate position during loading of the length of looper thread 30 extracted from bobbin 8 The thread 30 is now looped around finger 13 and has just slipped off the top horizontal surface of the shoulder 29 (FIG. 4a) and across the outer surface of the shoulder 29, and is just entering the long slot 24.

The retaining clip 10 is now swung in such a manner that its free end, as shown in FIG. 3, is received by the recess 20. In this way, the length of looper thread 30 from the bobbin 8 hanging out of the bobbin case 7 through the long slot 24 can no longer escape from the threading slot 22.

In operation, the needle-thread loop NF, which wraps around the bobbin case 7 when the stitch is formed, automatically brings the length of looper thread 30 to the end point 27 of the long slot 24, as illustrated in FIG. 4. No action by the operator is required In this way, both the looper thread 30 and the needle-thread loop NF are placed in position together so that the thread catcher 5 (see FIG. 2 and FIG. 3) which moves below the plane of the top surface 6 of the bobbin case 7, can dependably catch both the part of the needle-thread loop leading to the material being sewn, as well as the looper thread 30 emerging from the bobbin case 7, so that both threads can be cut off closely below the material being sewn.

Although the present invention has been described in relation to particular embodiments thereof, many other variations and modifications and other uses will become apparent to those skilled in the art It is preferred, therefore, that the present invention be limited not by the specific disclosure herein, but only by the appended claims.

What is claimed is:

1. In combination, a sewing machine looper which rotates in a horizontal plane;

a unitary bobbin case which is secured against rotation with respect to said looper and has means for receiving a bobbin with thread thereon, said bobbin case having a top surface; and a thread-cutting device including a thread-catcher;

said bobbin case having an upstanding generally cylindrical wall with at least first, second and third apertures therein, numbered according to the direction of rotation of said looper, said apertures being open at the top surface of the bobbin case and providing a thread path from inside to outside said bobbin case, wherein a thread from said bobbin may exit through said first aperture, reenter through said second aperture, and then exit through said third aperture;

said first and second apertures being defined by an upstanding finger which forms part of said wall;

a leaf spring being provided on said wall for bearing on said finger and thereby tensioning such thread as it passes from said first aperture to said second aperture along the radially outside surface of said wall; and guide means on said wall for guiding the thread, which extends from said bobbin case through said first aperture, into said second and third apertures to complete the threading of said bobbin case, and out of the third aperture and into position for being caught by said thread catcher and cut by said cutting device;

wherein said third aperture includes a generally vertical slot and a generally horizontal slot extending circumferentially of said wall in said looper rotation direction, which permits the thread to be pulled in said rotation direction by a needle-thread loop carried by said looper, to a downstream end of said slot, and thereby into position for being caught by said thread catcher and cut by said cutting device substantially simultaneously with said needle-thread.

2. A combination as in claim 1, wherein the downstream end of the horizontal slot is formed upstream from a downstream edge of said cam.

3. A combination as in claim 2, wherein said guide means includes a shoulder extending from the vertical slot and downstream beyond the end of the horizontal slot.

4. A combination as in claim 1, wherein said guide means comprises a shoulder having a downwardly angled and radially outward-facing surface on the outside of said bobbin case, for guiding the thread which has entered into said third aperture from above, downward and into said horizontal slot of said third aperture.

5. A combination as in claim 4, wherein an angle defined by said downwardly angled and radially outward-facing outer shoulder surface, with respect to said bobbin casing wall, decreases substantially continuously along said direction of looper rotation, until the shoulder blends into the wall surface.

6. A combination as in claim 4, wherein said third aperture is L-shaped, comprising said horizontal slot as well as said vertical slot which is accessible through said outlet formed in said cam, the vertical slot being defined at an upstream end of said shoulder, a portion of said shoulder at said upstream end also being accessible through said outlet formed in said cam.

7. A combination as in claim 1, wherein said guide means comprises an inwardly and downwardly sloping oblique slide surface formed in the top of said bobbin case wall, which defines said upper surface of the bobbin case between said second and third apertures, for guiding the thread into said second and third apertures.

8. A combination as in claim 1, wherein said guide means comprises an oblique slide surface which is provided on the bobbin case in the region between the finger and the third aperture, partly defining said second and third apertures, and having rounded and smooth thread-engaging surface.

9. A combination as in claim 1, wherein said third apertures is L-shaped, comprising said horizontal slot as well as said vertical slot which is accessible through said outlet formed in said cam, the vertical slot being defined at an upstream end of said shoulder, a portion of said shoulder at said upstream end also being accessible through said outlet formed in said cam.

10. In combination, a sewing machine looper which rotates in a horizontal plane;

a unitary bobbin case which is secured against rotation with respect to said looper and has means for receiving a bobbin with thread thereon, said bobbin case having a top surface; and a thread-cutting device including a thread-catcher;

said bobbin case having an upstanding generally cylindrical wall with at least first, second and third apertures therein, numbered according to the direction of rotation of said looper, said apertures being open at the top surface of the bobbin case and providing a thread path from inside to outside said bobbin case, wherein a thread from said bobbin may exit through said first aperture, reenter through said second aperture, and then exit through said third aperture;

said first and second apertures being defined by an upstanding finger which forms part of said wall;

a leaf spring being provided on said wall for bearing on said finger and thereby tensioning such thread as it passes from said first aperture to said second aperture along the radially outside surface of said wall; and guide means on said wall for guiding the thread, which extends from said bobbin case through said first aperture, into said second and third apertures to complete the threading of said bobbin case;

wherein one end of the leaf spring which lies against the finger has a radially outwardly bent corner at an upper side thereof, which facilitates insertion of the thread between the finger and the leaf spring.

11. In combination, a sewing machine looper which rotates in a horizontal plane;

a unitary bobbin case which is secured against rotation with respect to said looper and has means for receiving a bobbin with thread thereon, said bobbin case having a top surface; and a thread-cutting device including a thread-catcher;

said bobbin case having an upstanding generally cylindrical wall with at least first, second and third apertures looper, said apertures being open at the top surface of the therein, numbered according to the direction of rotation of said bobbin case and providing a thread path from inside to outside said bobbin case, wherein a thread from said bobbin may exit through said first aperture, reenter through said second aperture, and then exit through said third aperture;

said first and second apertures being defined by an upstanding finger which forms part of said wall;

a leaf spring being provided on said wall for bearing on said finger and thereby tensioning such thread as it passes from said first aperture to said second aperture along the radially outside surface of said wall; and guide means on said wall for guiding the thread, which extends from said bobbin case through said first aperture, into said second and third apertures to complete the threading of said bobbin case;

wherein said guide means comprises a cam which extends radially outward from the top surface of the wall, the cam being penetrated by an outlet formed therein, the outlet having an obliquely directed threading slot which interrupts the cam for receiving the thread.

12. A combination as in claim 11, wherein the oblique orientation of the threading slot is provided by a portion of an upper cam tip being disposed downstream of a portion of a lower cam tip, referred to the direction of rotation of the looper.

13. A combination as in claim 12, wherein said lower cam tip is disposed substantially radially outward of said third aperture.

14. A combination as in claim 11, further comprising a retaining clip having a closed position for retaining said bobbin in said bobbin case, said outlet being shaped for receiving said retaining clip in said closed position and thereby closing said outlet and said third aperture.

15. A unitary bobbin case for being secured against rotation with respect to a sewing machine looper which rotates in a horizontal plane and having means for receiving a bobbin with thread thereon, said bobbin case having a top surface, and being associated with a thread-cutting device including a thread-catcher, the bobbin case comprising;

an upstanding generally cylindrical wall with at least a pair of thread passage apertures, wherein said apertures are open at the top surface of the bobbin case, and are defined by a stationary, upstanding finger which forms an integral part of said wall;

said apertures including a generally horizontal slot extending circumferentially of said wall in a looper rotation direction, which permits the thread to be pulled in said rotation direction by a needle-thread loop carried by said looper, to a downstream end of said slot, and thereby into position for being caught by said thread catcher and cut by said cutting device substantially simultaneously with said needle thread; and said wall having guide means for guiding thread from said bobbin into position for being caught by said thread catcher and cut by said cutting device.

16. A bobbin case as in claim 15, wherein the downstream end of the horizontal slot is formed upstream from an end part of said guide means with respect to said rotation direction.

17. A bobbin case as in claim 16, wherein said guide means includes a shoulder extending downstream beyond the end of the horizontal slot.

18. A bobbin case as in claim 15, wherein said guide means comprises a shoulder having a downwardly angled and radially outward-facing surface on the outside of said bobbin case, for guiding a thread which has entered into said apertures from above, downward and into said horizontal slot.

19. A bobbin case as in claim 18, wherein an angle defined by said downwardly angled and radially outward-facing outer shoulder surface, with respect to said bobbin case wall, decreases substantially continuously along said direction of looper rotation, until the shoulder blends into the wall surface.

20. A bobbin case as in claim 15, wherein said apertures further include a vertical slot which is accessible from above said bobbin case, the vertical slot being defined at an upstream end of said shoulder and communicating with said horizontal slot.

21. A bobbin case as in claim 15, wherein said guide means comprises an oblique slide surface which is provided on the bobbin case near the aperture, partly defining said wall near the aperture, and having rounded and smooth thread-engaging surfaces.

22. A bobbin case as in claim 15, wherein said guide means comprises an inwardly and downwardly sloping oblique slide surface formed in the top of said bobbin case wall, which defines said upper surface of the bobbin case between said apertures, for guiding the thread into said apertures.

23. A unitary bobbin case for being secured against rotation with respect to a sewing machine looper which rotates in a horizontal plane and having means for receiving a bobbin with thread thereon, said bobbin case having a top surface; and for being associated with a thread-cutting device including a thread-catcher;

said bobbin case having an upstanding generally cylindrical wall with at least one thread exit aperture, said aperture having means for guiding thread from said bobbin into position for being caught by such thread catcher and cut by such cutting device;

wherein said guide means comprises a cam which extends radially outward from the top of the wall, the cam being penetrated by an outlet formed therein, the outlet having an obliquely directed threading slot which interrupts the cam for receiving a thread.

24. In combination, a sewing machine looper which rotates in a horizontal plane;

a unitary bobbin case which is secured against rotation with respect to said looper and has mean for receiving a bobbin with thread thereon, said bobbin case having a top surface; and a thread-cutting device including a thread-catcher;

said bobbin case having an upstanding generally cylindrical wall with at least first, second and third apertures therein, numbered according to the direction of rotation of said looper, said apertures being open at the top surface of the bobbin case and providing a thread path from inside to outside said bobbin case, wherein a thread from said bobbin may exit through said first aperture, reenter through said second aperture, and then exit through said third aperture;

said first and second apertures being defined by an upstanding finger which forms part of said wall;

a leaf spring being provided on said wall for bearing on said finger and thereby tensioning such thread as it passes from said first aperture to said second aperture along the radially outside surface of said wall; and guide means on said wall for guiding a thread, which extends from said bobbin case through said first aperture, into said second and third apertures to complete the threading of said bobbin case, and out of the third aperture and into position for being caught by said thread catcher and cut by said cutting device;

wherein the guide means comprises a cam which extends radially outward from the top surface of the wall, and the finger is directed parallel to a spindle sleeve arranged in the center of the bobbin case, the finger being surrounded by a recess in the cam which communicates with the first and second apertures.

25. A combination as in claim 24, wherein all thread-engaging surfaces of the finger, the recess and the first and second apertures are rounded and smooth.

* * * * *